United States Patent [19]

Reuter et al.

[11] 4,262,474

[45] Apr. 21, 1981

[54] WEB FEEDING SYSTEM FOR PACKAGE FORMING MACHINE

[75] Inventors: Daniel L. Reuter, Waldorf, Md.; Philip L. Reid, Duncan, S.C.; Charles M. Blackburn, Davidsonville, Md.; Clifton W. Heffner, Charlotte, N.C.

[73] Assignee: Sigma Systems, Inc., Capitol Heights, Md.

[21] Appl. No.: 955,574

[22] Filed: Oct. 30, 1978

[51] Int. Cl.[3] ..... B65B 9/08; B65B 41/14; B65B 51/30

[52] U.S. Cl. ..... 53/551; 53/389

[58] Field of Search ..... 53/552, 551, 550, 548, 53/373, 389

[56] References Cited

U.S. PATENT DOCUMENTS

| | | | |
|---|---|---|---|
| 2,955,398 | 10/1960 | Dreeben | 53/389 X |
| 3,381,441 | 5/1968 | Condo, Jr. et al. | 53/551 X |
| 3,488,914 | 1/1970 | Csernak | 53/551 X |
| 4,074,508 | 2/1978 | Reid | 53/389 X |
| 4,128,985 | 12/1978 | Simmons | 53/551 X |
| 4,144,693 | 3/1979 | Ogata | 53/552 X |

*Primary Examiner*—Horace M. Culver
*Attorney, Agent, or Firm*—Laurence R. Brown

[57] ABSTRACT

A web feeding system reels the web off a web roll in increments of predetermined length for forming a package by a braked web spool and dancing roller array to pass through a work station such as a printer for registration at package sealing stations. The web is yanked, one package length at a time, by a reciprocating web transit motivating member grasping and withdrawing the web from the roll on an advance stroke and synchronized to brake the roll and to prevent movement through the feed path upon the return stroke.

11 Claims, 4 Drawing Figures

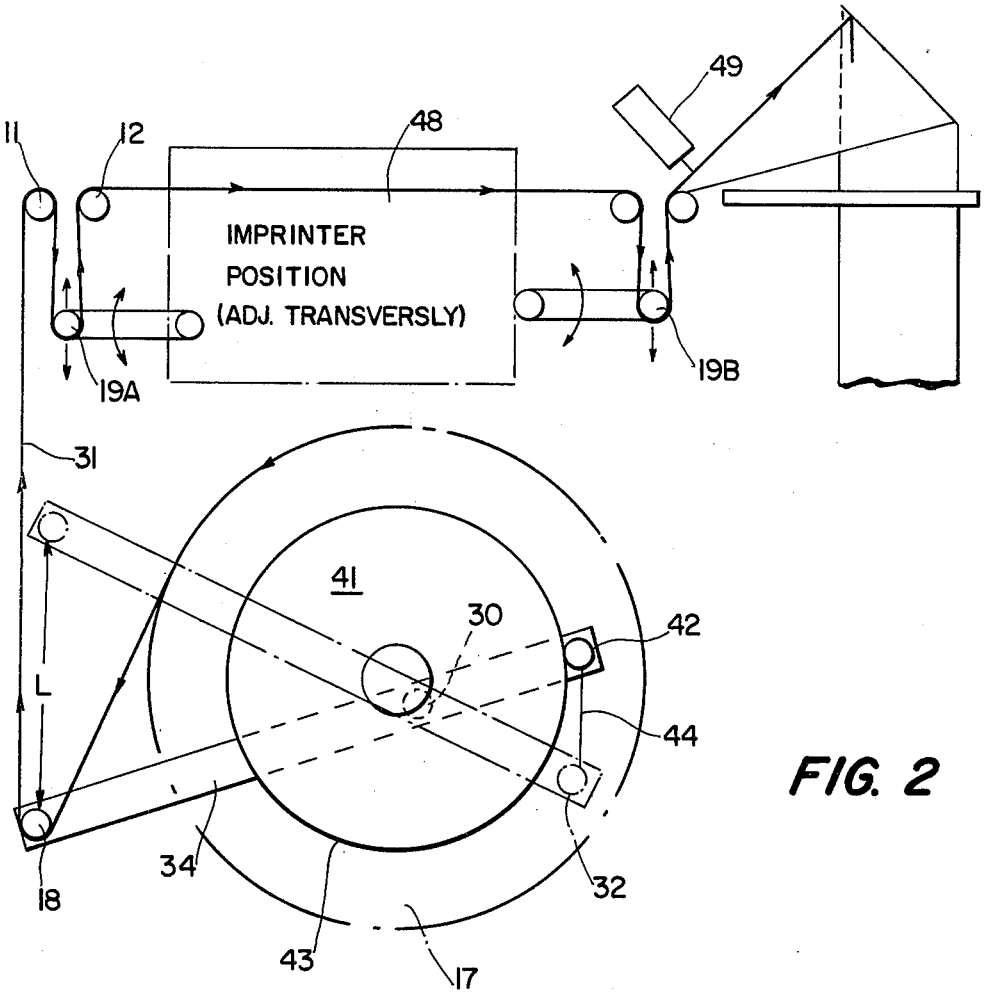
FIG. 2
FIG. 3
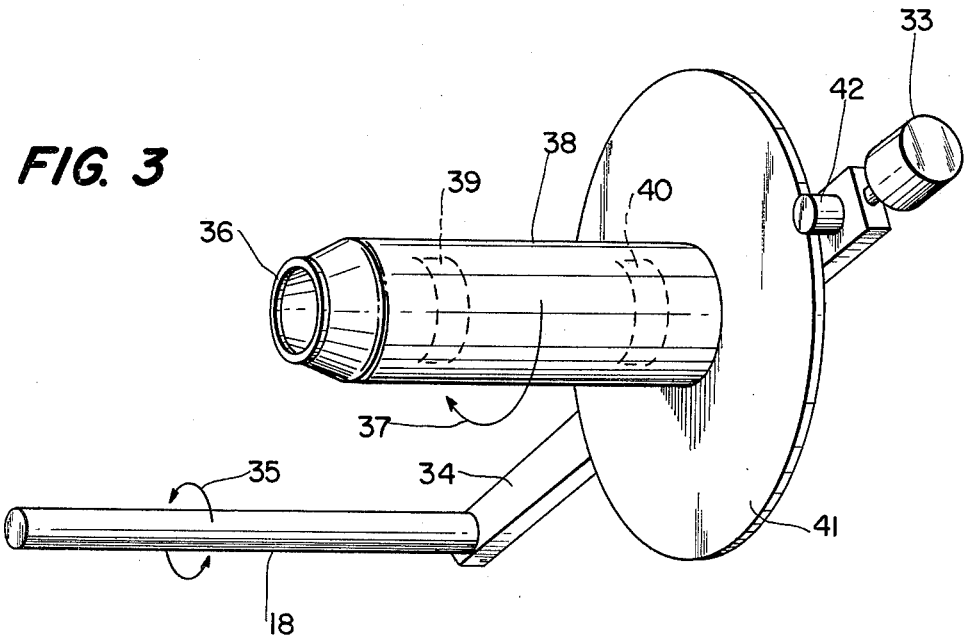

WEB FEEDING SYSTEM FOR PACKAGE FORMING MACHINE

TECHNICAL FIELD

This invention relates to packaging machinery systems for forming a continuous web into a sequence of packages containing products such as food and hardware, and more particularly it relates to the means processing the web in a feed path through the packaging system.

BACKGROUND ART

The most representative background art relating to this invention is the U.S. Pat. No. 2,762,176 issued Sept. 11, 1956 to K. D. Knapp et al. for a wrapping machine. However, this type of machine does not form a package in a continuous web and fill it with a product before cutting the package from the web. It does not therefore solve the problems presented by a complete automated product packaging machine that need fold and seal a web to form a package about a product with enough versatility to handle packages of various sizes with various kinds of products inserted therein.

Automatic multi-purpose packaging machines are generally known such as in U.S. Pat. No. 3,054,246 issued Sept. 18, 1962 to J. H. Stroop.

The mechanisms involved tend to be complex and critical as to changes in package contents and size. Packaging systems currently commercially available such as the form-fill-seal system of Sigma Systems, Inc., of 231 Westhampton Ave., Capitol Heights, Maryland 20027, and of Package Machinery Co., East Longmeadow, Maine, are complex, expensive and present difficulties in replacing loading and threading web rolls. Most systems require passing the web over a large number of rollers in a web feed system to equalize forces along the web while withstanding the longitudinal forces exerted along the web without excessive stretching or tearing, and to permit registration and alignment of the web throughout the system and particularly at work stations. Thus, web roll changeover and threading through these complex systems is time consuming and tedious. The cabinet structure and location of the web path also in prior art machines interferes with web change although readily accessible and changeable web rolls are known in less complex systems such as in U.S. Pat. No. 3,988,970 issued Nov. 2, 1976 to V. Hansen et al.

In some machines an intermittent asynchronous cycle is used. This puts great demands on web tension and webs frequently stretch or break when processing speeds are increased with highly accelerated starts or yanks on the web for pulling enough tape from a storage roll to form each package. Wherever reciprocating mechanisms are used to process these problems increase because of start up acceleration forces.

Another problem is that the web travel need be interrupted by a relatively long package seal time that is difficult to achieve consistently with high output capacity because it is necessary to keep the web stationary while sealing. This reduces output speed and requires complex web feeding systems to relieve strains and to produce timing of the required events in an automated system.

Timing and control systems are therefore very complex in fully automated packaging machines.

A general object of this invention therefore is to resolve one or more of these prior art problems in a novel packaging system with simplified web feed and controls.

It is another object of this invention to provide in a versatile package forming machine a simplified web processing system useful in a versatile packaging operation that can run asynchronously at high packaging speeds and process different package sizes automatically.

Also it is an object of this invention to provide a web feed system simplified with few parts and having all parts readily accessible for quick replacement of a new web roll.

Other objects, features and advantages of the invention will be found throughout the drawings and description of the invention and its preferred embodiment.

BRIEF DESCRIPTION OF THE DRAWINGS

FIG. 2 shows a schematic sketch of the web travel path with associated web feeding, braking and processing equipment;

FIG. 3 shows a perspective view of a web roll spool assembly and its cooperating tensioning-feed-brake system.

DISCLOSURE OF THE INVENTION

The invention therefore provides a web feed and processing system for producing packages about a product such as a number of bolts or peanuts from a continuous web fed off a roll. The system provides for asynchrononous operation to form packages upon command at high repetitive speeds and includes such features as automated change of package length, simplified tensioning, processing, and feeding of the web compatible with accelerated start up speed and high speed package formation. Preferably the web is of a thermoset plastic and can be processed to register pre-printed patterns for printing codes, pricing, etc. during processing.

The motive transit drive for the entire web path through the machine is a reciprocating web advance mechanism that transversely seals a folded over web to form package ends while pulling the designated length of web from a web roll through the web feed path.

Automatic braking and sealing cycles are simplified and reliable, but operate in a versatile control mode in full view for trouble shooting and startup from new web rolls, with all mechanisms processing the web being exposed on a single side of a panel in cantilevered form.

PREFERRED EMBODIMENT OF THE INVENTION

Figure 1:
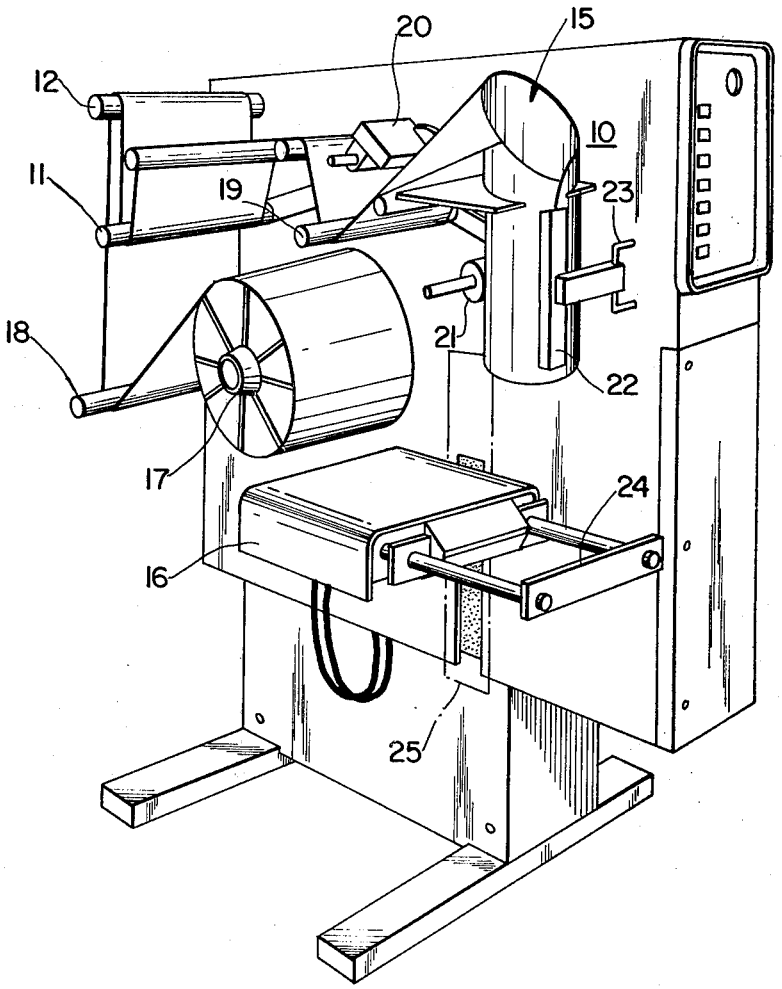
FIG. 1 shows in perspective view the cantilevered mounting of the web processing system in an automatic packaging system afforded by this invention.

With reference to FIG. 1 it is to be seen that the entire web feed system is accessible from one side of the panel 10 with various cantilevered rollers 11, 12, etc., a web folding assembly and product entry tube 15 and a reciprocating end seal carriage 16 which provides the sole web transmit motive power.

A continuous web is thus unwound from web roll 17 about tensioning, braking and web roll unwinding dancing roller mechanism 18, which is better set forth to be later described with reference to FIGS. 2 and 3.

Movable registration rollers 19 can change the length of the web in the travel path and can serve with photo detectors 20 or the like to register pre-printed patterns for an update printing code entry for example. These are necessary particularly when changes in package length need to be made. Also when new rolls are inserted automatic registration can be effected with pre-printed patterns on the web. Chutes 15 may be changed if desired by sliding onto shaft 21 to conform to different web and package widths and different package lengths.

Two layers of the web are sealed longitudinally together by the pivoted heat-seal brake member 22 which pivots about a position 23 near the plane of panel 10. The heater therein is just hot enough to seal together two web layers but not to burn the web, so that it is not critical in length of contact time.

The web is advanced by the lateral heat seal and clamping mechanism 24 which reciprocates such as by vertical movement in slot 25 to close and grab the web at its uppermost position and to open and release it at the lowermost position, thereby grabbing and yanking a proper tape length from web roll 17 while sealing the web laterally with a heated bar as it travels either during the downward stroke or/and as it rests in an upper position before movement for sealing before a product is inserted into tube 15. Vertical seal 22 acts as a brake member to keep the web from reverse movement when engaged. It is pivoted away from the web at pivot member 23 premitting it to move through the web path in timing with the carriage 16 movement downwardly. The detailed operation of the clamping and sealing mechanism is set forth in my concurrently filed application Ser. No. 955,752, but is not deemed necessary for an understanding of the present invention.

A further brake operable on the web roll to prevent backlash is depicted in FIGS. 2 and 3 as operable by the dancing roller assembly 18, similar in general operation to that in the foregoing Knapp patent. Thus the roller 18 uses the force of gravity by the pivot arm about axis 30 to engage web 31 and rotate web roll 17 counterclockwise to meter out an appropriate length of web L to form a package as the dancing roller 18 pivots downwardly from the upward limit at phantom position 32. A counterbalance 33 can be adjusted for proper web tension, and also the length of the pivoted dancing roller arm and weight of the roller 18 which is fastened to pivot arm 34 for rotation as arrows 35 indicate can be varied to fit different web conditions.

This mechanism has novel features including the following: A web roll of any desirable width is inserted over tapered end 36 of the rotatable (37) web roll spool assembly 38 and held in place by end mounts 39 and 40, with disk 41 spaced from the web roll end to avoid interference. The circumferential edge 43 of the disk 41 serves as a braking surface encountering brake block 42 carried by pivot arm 34 in encountering the disk edge on a tangential path 44. Thus a very simple structure serves to prevent tearing of the web as it is yanked through the system by releasing the length needed by lifting pivot arm 34 during the feed acceleration period and then as the web is stopped by producing a gentle unrolling of web from spool 17 by gravity action on roller 18. This operates well from full to empty web rolls and is not critical for webs having different widths, weights, strengths and elasticity.

The remainder of the web travel path operating in conjunction therewith is simple for threading over rollers 11, 19A, 12, etc. Adjustable roller 19A can permit registration of pre-printed patterns on web 31 with an imprinter 48 for coding, pricing or addressing a package. Similarly registration roller 19B can adjust the registration of a pattern with the longitudinal sealer mechanism 22 (FIG. 1). Both registration rollers can be servoed for automatic alignment in response to photo detectors 49 or the like.

In operation the web is simply hand threaded without necessitating any power cycle or operation through a machine cycle to pull the web into place. Thus, the web is passed over tube former 15 and vertically dropped into jaw assembly 24 where it is thereafter grasped for a machine operation.

Figure 4:
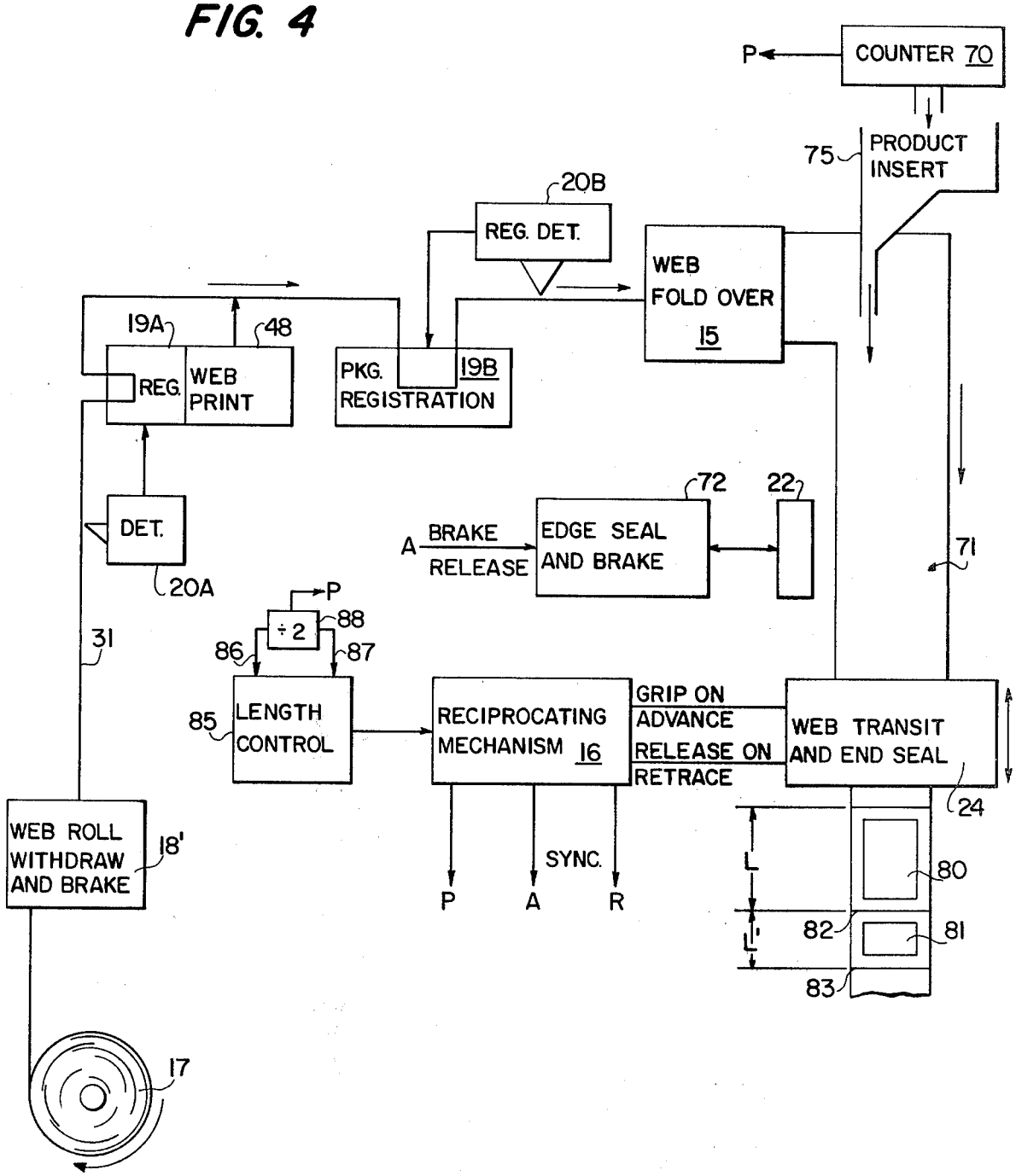
FIG. 4 is a schematic control diagram of the packaging system incorporating the features of the foregoing figures and adopted for automatic control of versatile packaging requirements.

FIG. 4 shows in block schematic form the various control circuits and interrelated mechanisms to illustrate the operation of an asynchronously operated automatic packaging system constructed in accordance with the invention, and thereby advantageously using the web feed system hereinbefore described to produce packaged products at high speeds in the order of 120 packages per minute. Similar reference characters identify those elements hereinbefore described for ready comparison.

In operation it is desirable to have asynchrous control so that whenever a product is ready to package such as when a dozen bolts or 32 peanuts is ready for packaging at counter 70 the machine is triggered by package forming command P for advancing the web and forming a package around the product. Thus, the command signal P is derived to trigger a web withdrawal cycle by actuating reciprocating mechanism 16 to pull the web from roll 17 and transversely end/seal the folded over web portion 71 after it is edge sealed longitudinally by element 22.

As the transit device 24 grabs, seals and advances the web 71, an advance signal A is generated to release the edge seal and brake 22 at control device 72, permitting the web to be pulled from roll 17. The transit device 24 exerts tension on web 31 but does not need to unroll a heavy web roll but only to raise the web dancing roller-brake assembly 18' as hereinbefore described so that the web is not unduly stretched or broken by acceleration of the transit means 24 which yanks a new length of web through the feel path. A similar signal R can be generated if desired in the system for auxiliary controls that need occur on the release and retrace stroke of transit means 24.

The counter or other product input source releases a batch of products in chute 75 for insertion in the web package sealed at the edge along 82 and limits signal P as the web is stationary and braked while the seal member 22 seals the web longitudinally (during the retrace period R). A transverse package seal is made by end seal device 24 as it clamps and holds the folded over edge sealed web 71. Thus by clamping and/or sealing, the products in the package are retained until a transverse seal at the top completes the package. Thus, for example, two sequential packages 80, 81 on an uncut web may be formed with lateral seals 82 therebetween, and the web can be cut near the seals 82 for example to produce dual package unit 80, 81.

The packaging machine system and web feed embodiment of this invention is particularly adopted to automated control of package length. Thus, for example, suppose a dozen bolts need be packaged in longer, unit 80 and a dozen nuts in shorter unit 81 for a two package unit comprising with different package lengths L and L'. Then the length of reciprocation of mechanism 16 and transit unit 24 which carries along with it web 71 is controlled by a length control means 85 determining the stroke of the web withdrawal. By setting two predetermined lengths L and L' at respective command points 86, 87 the respective package lengths for packages 80, 81 are set up for corresponding stroke lengths of transit means 24. Then by a binary counter 88, each product ready command pulse P can alternately produce short and long pulses for a sequence of packages of alternating length. Other simple control circuits can produce such similar automatic length selection by triggering of L for one product and L' for another product or for producing an entire product run at the same predetermined length, as desired.

It is therefore seen the versatile, novel and simple web feed and packaging system of this invention advances the state of the art and produces a new machine operating in an improved mode for increasing the flexibility and speed of automatic packaging machines.

INDUSTRIAL APPLICABILITY

The web feed system of this invention is particularly adopted to an intermittently and asynchronously operated packaging system that produces one package array at a time on the end of a continuous web stored on a roll by advancing from time to time a predetermined length of web from a storage roll as necessary to form a new package array. The winding and reeling system provides for simple web replacement, simple reeling equipment handling, imprinting of local indicia such as pricing or coding in registration on the web with preprinted cyclic patterns on the web, and is particularly adopted for automatic changes of package size and web length processed for different package arrays.

We claim:

1. A packaging machine having a feed system for advancing a web asynchronously from a rotatable web roll in separated incremental periods by release of corresponding incremental lengths and for forming therewith a package, including web advancing means for pulling the web through the feed system consisting of a reciprocating member for grasping the web at a position following the formation of the package to move it over said incremental lengths and returnable to grasp a succeeding length of web, and braking means having a brake member movable into braking engagement with said web role for controlling rotation of the web roll and including a feed roller operated solely by movement of the brake member as it moves into braking engagement with the feed roll to meter out a length of web substantially equal to a package length before the brake is reengaged, whereby feed of the web through the feed system will occur primarily from said length only during the incremental period that the web is grasped and advanced by said advancing means.

2. A packaging machine as defined in claim 1 wherein the braking means comprises two members located respectively to brake web travel at positions along the web travel path located near the web roll and near the advancing means, and control mechanisms for operating both said brakes during the periods that the web is not being pulled through the feed system.

3. A packaging machine as defined in claim 1 having a work station positioned adjacent the web travel path in said feed system with a characteristic that requires precise registration with predetermined increments of the web length, and an adjustable roller in the web path for establishing a variable path length of the web through the feed system.

4. A packaging system as defined in claim 1 for processing a pre-printed web roll having a repetitive pattern along the length of the web, further comprising a pattern detection device positioned to detect the web pattern, and means responsive to the detection of the pattern by said device for conditioning said reciprocating member thereby to pull a length of said web from said feed system with said pattern along said predetermined length.

5. A system as defined in claim 1 including means for automatically adjusting the web feed system for changes in package length programmed by movement of said reciprocating member to pull different lengths of web from said roll.

6. A system as defined in claim 5 including means for forming adjacent packages by said machine of differing package length.

7. A system as defined in claim 1 including means for placing a longitudinal seal on the web while the web is stationary.

8. A system as defined in claim 7 including means for placing a lateral seal on the web while the web is moved by said advancing means.

9. A packaging machine operable to produce upon intermittent command a package array comprising in combination, means for forming a sequence of packages from a continuous web material fed from a rotatable web roll, means for processing the web through a feed system comprising a sequence of feed rollers and a folding device providing two web layers, intermittently operated motivating means for pulling a length of the web taken from said roll upon command to form a package comprising a movable member for grasping the web and for sealing its two layers together laterally while the web travels through said feed system, an intermittently operable longitudinal sealing and braking means for clamping the web in its longitudinal travel path against a fixed member and for sealing it while at rest and thereby forming a brake impeding the travel of the web, means for operating said longitudinal sealing and braking means to prevent travel of the web after said length of web is pulled through said feed system said length, and a dancing roller mechanism for metering off said roll a replacement length of web when the braking means holds the web to release from the roll a length of web held in readiness for a further package forming operation by pulling it through the system, said dancing roller mechanism having braking means for retaining the web roll from rolling when a length suitable for forming a package is metered out.

10. A packaging system for introducing a product into a length of continuous web and for sealing the product therein to form a package and including means for reeling a web off a web roll in increments of predetermined length to form the package in response to intermittent yanks by web transit motivation means comprising in combination, said web interspersed through various system elements to interact therewith and to interrelate system functions thereby with a supply of said web stored on said roll, said motivation means operable by a reciprocating mechanism for grasping the web and yanking it for movement over said length on an advance reciprocating stroke, means for feeding the web from said roll downwardly over a roller mechanism pivotable about a shaft for movement downward by gravity to a limiting position and thereafter upwardly through a web feed path between said roll and said motivation means, pivot means engaging said web pivotable between two limiting positions establishing sufficient downward gravity force during the return reciprocating stroke of said motivation means to withdraw said predetermined length of web from said roll, a spool for mounting said roll having an end flange disc rotatable therewith at a position spaced away from the end of the web roll, braking means for establishing the first said limiting position and located on said pivotable roller mechanism for tangentially moving into engagement with the edge of said disc and thereby braking said web spool and roll at said downward limiting position until an upward movement by said web in response to said reciprocating mechanism overcomes said force of gravity and pivots the roller mechanism upwardly to release the brake means from the edge of the disc, and further braking means operable during the return reciprocation stroke for retaining the web in position in said web feed path, whereby intermittent feeding of predetermined lengths of the web is achieved without backlash of the web roll over the entire range of web supply on the roll.

11. A packaging machine with program means for making adjacent packages of different lengths from a continuous web fed through a web feed path from a web roll, comprising in combination, means for initiating upon a command signal the release of the web asynchronously for each package unit formed from said web, intermittently actuatable web advancing means responsive to said command signal for pulling a programmed variable length of web from said roll constituting the sole motive transit means for passing the web through said path, means for establishing programs for pulling at least two different web lengths on command, means for selecting said programs in a succession in response to successive said command signals thereby for withdrawing sequentially from said roll two different lengths for forming therewith corresponding packages of different lengths, web processing means for passing the web from the roll to the web advancing means, and means for braking both the web roll and the passage of the web through said path when said web advancing means is not pulling tape through said web feed path.

* * * * *